US011389933B2

(12) United States Patent
Chellew

(10) Patent No.: US 11,389,933 B2
(45) Date of Patent: Jul. 19, 2022

(54) ANTI-TOPPING IMPACT TOOL MECHANISM

(71) Applicant: Ingersoll-Rand Company, Davidson, NC (US)

(72) Inventor: Justin Chellew, Bethlehem, PA (US)

(73) Assignee: Ingersoll-Rand Industrial U.S., Inc., Davidson, NC (US)

( * ) Notice: Subject to any disclaimer, the term of this patent is extended or adjusted under 35 U.S.C. 154(b) by 169 days.

(21) Appl. No.: 16/589,095

(22) Filed: Sep. 30, 2019

(65) Prior Publication Data

US 2021/0094157 A1 Apr. 1, 2021

(51) Int. Cl.
*B25B 21/02* (2006.01)
*B25D 17/06* (2006.01)

(52) U.S. Cl.
CPC ..... *B25B 21/02* (2013.01); *B25D 17/06* (2013.01)

(58) Field of Classification Search
CPC ... B25B 21/02; B25B 21/026; B25B 23/1453; B25B 23/1405; B25B 19/00; B25D 2211/064
USPC ..... 173/2, 93, 93.5
See application file for complete search history.

(56) References Cited

U.S. PATENT DOCUMENTS 6,223,834 B1 * 5/2001 Takamura ..... B25B 21/02 173/211
2002/0060082 A1 * 5/2002 Watanabe ..... B25B 23/1405 173/176
2009/0038816 A1 * 2/2009 Johnson ..... B25B 21/026 173/109
2014/0158388 A1 * 6/2014 Johnson ..... B25B 21/026 173/1
2014/0338942 A1 * 11/2014 Putney ..... B25B 21/02 173/93
2015/0165604 A1 * 6/2015 Bartoszek ..... B25B 21/02 173/1
2016/0129568 A1 * 5/2016 Nishikawa ..... B25B 21/02 173/93
2017/0144278 A1 * 5/2017 Nishikawa ..... B25B 21/026

* cited by examiner

*Primary Examiner* — Anna K Kinsaul
*Assistant Examiner* — Veronica Martin
(74) *Attorney, Agent, or Firm* — Kevin E. West; Advent, LLP

(57) ABSTRACT

An impact tool has an anti-topping mechanism ("ATM") adapted to reduce the rotational frictional force between the contact surfaces of the hammer and anvil to prevent topping. If topping still occurs, the ATM quickly breaks the topped condition. The ATM may reduce the rotational frictional torque between the hammer and anvil of an impact mechanism or provide increased the rotational friction acting on the anvil from adjoining elements of the tool thus tending to hold the anvil (by heightened rotational friction) while the hammer can be broken free. ATM mechanisms include hammer and jaw surfaces angled at interface points; stepping either the hammer or anvil jaw surfaces so that only the innermost portions interact; rounding or crowning either or both of the anvil and hammer jaw surfaces so minimal portions of the jaws are ever topped; and software-controlled detection and breaking of a topped condition. In torque-controlled impact tools, these mechanisms decrease the risk of accuracy or repeatability issues.

14 Claims, 10 Drawing Sheets

ANTI-TOPPING IMPACT TOOL MECHANISM

TECHNICAL FIELD

The present disclosure generally relates to impact tools and, more specifically, to impact tools that reduce or eliminate the risk of topping when the impact tool comes to a stopped position.

BACKGROUND

An impact tool is a power tool that delivers a high-torque output with minimal exertion by the user. For example, an impact wrench generally includes a motor coupled to an impact mechanism that converts the torque of the motor into a series of powerful rotary strikes directed from one or more hammers to an output shaft affixed to integrated with an anvil. The output shaft may be coupled to a fastener (e.g., bolt, screw, nut, etc.) to be tightened or loosened, and each strike of the hammer on the anvil provides torque to the fastener. The intermittent nature of impact loading of an impact wrench enables it to deliver higher torque to a fastener than a constant-drive tool, such as an electrical drill. Some impact tools incorporate torque control ("torque-controlled impact tools") to enable a user to apply more or less torque through the impact tool, depending on the needs of a specific application.

Hammer-anvil topping ("topping") impedes the function of impact tools having at least one hammer jaw and at least one anvil jaw. Topping occurs in a tool having a ball and cam impact mechanism when the top surfaces of the hammer jaws and lower surfaces of the anvil jaws are in contact with each other in an axially aligned parallel position. In a topping circumstance, the hammer and anvil of an impact tool come to a stop with the hammer jaw surfaces and the anvil jaw surfaces sitting on top of each other, creating excess, non-optimal rotational frictional force. This contact is not ideal: significant spring pressure is applied through the hammer jaw to the anvil jaw surfaces and through the entirety of the impact mechanism. In order for the impact tool to continue to function properly when subjected to this spring pressure, a higher rotational starting torque needed the next time the impact tool is activated to move the hammer jaw from its spring loaded contact with the anvil jaw. In torque-controlled impact tools, this higher rotational starting torque increases the risk of accuracy or repeatability issues.

SUMMARY

The disclosed examples are described in detail below with reference to the accompanying drawing figures listed below. The following summary is provided to illustrate some examples disclosed herein. It is not meant, however, to limit all examples to any particular configuration or sequence of operations.

Some embodiments are directed to an impact tool having: a tool shaft adapted to rotate about an axis; a hammer adapted to rotate about the axis and comprising a hammer jaw, the hammer jaw comprising a hammer jaw forward impact surface and a hammer jaw top surface that is perpendicular to the hammer jaw forward surface; and an anvil adapted to rotate upon impact with the hammer jaw, the anvil comprising an anvil jaw with an anvil jaw bottom surface and an anvil jaw forward impact surface that is perpendicular to the anvil jaw bottom surface. In such embodiments, the hammer jaw top surface is, at least partially, angled relative to the anvil jaw bottom surface.

In some embodiments, the hammer jaw top surface is crowned.

In some embodiments, the hammer jaw top surface comprises a raised surface.

Some embodiments include: at least one sensor configured to detect a position of the hammer jaw relative to the anvil jaw; and a control unit configured to: detect that the hammer jaw and the anvil jaw are in a topping state, and incident to said detection of the topping state, generate a signal for moving the hammer jaw to disrupt the topping state (in certain instances to quickly break loose the toped condition upon the next startup).

In some embodiments, the generated signal is configured to cause a motor to rotate the hammer.

In some embodiments, the generated signal is configured to cause a motor to rotate the hammer less than a full revolution of the hammer.

In some embodiments, the anvil jaw bottom surface defines at least one raised surface that extends toward the hammer jaw top surface.

In some embodiments, the anvil jaw bottom surface is angled relative to the hammer jaw top surface.

In some embodiments, the anvil jaw bottom surface is crowned relative to the hammer jaw top surface.

Some embodiments also include an electric motor configured to drive rotation of the hammer around the axis to cause impact of the hammer jaw with the anvil jaw.

Some embodiments also include a pneumatic motor configured to drive rotation of the hammer around the axis to cause impact of the hammer jaw with the anvil jaw.

In some embodiments, the hammer jaw is angled along an upper side facing the anvil.

Other embodiments are directed to an impact tool having: a tool shaft adapted to rotate about an axis; a hammer adapted to rotate about the axis and comprising, the hammer comprising a hammer jaw top surface, a hammer jaw forward impact surface, and a hammer jaw reverse impact surface; and an adapted to rotate about the axis, the anvil comprising an anvil jaw bottom surface, an anvil jaw forward impact surface, and an anvil jaw reverse impact surface. In such examples, the anvil jaw bottom surface includes a portion that is angled or crowned.

In some embodiments, the hammer jaw top surface is either angled or crowned.

In some embodiments, the hammer jaw top surface comprises a raised surface.

Some embodiments also include at least one sensor configured to detect a position of the hammer jaw relative to the anvil jaw; and a control unit configured to: detect that the hammer jaw and the anvil jaw are in a topping state, and incident to said detection of the topping state, generate a signal for moving the hammer jaw to disrupt the topping state.

Some embodiments also include an electric motor configured to drive rotation of the hammer around the axis to cause impact of the hammer jaw with the anvil jaw.

Still other embodiments are directed to impact tool having: a tool shaft adapted to rotate about an axis; a hammer adapted to rotate about the axis and comprising at least one hammer jaw, the at least one hammer jaw having a hammer jaw top surface that is either crowned or angled; and an anvil adapted to rotate upon impact with the at least one hammer jaw, the anvil comprising an anvil jaw having an anvil jaw bottom surface facing the hammer. The anvil jaw bottom surface defines: a raised portion that protrudes from the anvil in the direction of the hammer, and a recess that extends out from the axis radially beyond the central anvil portion.

In some embodiments, the anvil jaw is positioned at, or substantially at, an outer radial edge of the anvil.

In some embodiments, the anvil jaw bottom surface is angled or curved.

In some embodiments, the hammer jaw top surface is angled or curved.

This Summary is provided to introduce a selection of concepts in a simplified form that are further described below in the Detailed Description. The foregoing Summary, as well as the following Detailed Description of certain embodiments, will be better understood when read in conjunction with the appended drawings. This Summary is not intended to identify key features or essential features of the claimed subject matter, nor is it intended to be used as an aid in determining the scope of the claimed subject matter.

BRIEF DESCRIPTION OF THE DRAWINGS

These and other features, aspects, and advantages of the present disclosure will become better understood when the following detailed description is read with reference to the accompanying drawings, wherein.

Corresponding reference characters indicate corresponding parts throughout the drawings in accordance with various embodiments.

DETAILED DESCRIPTION

Figure 1:
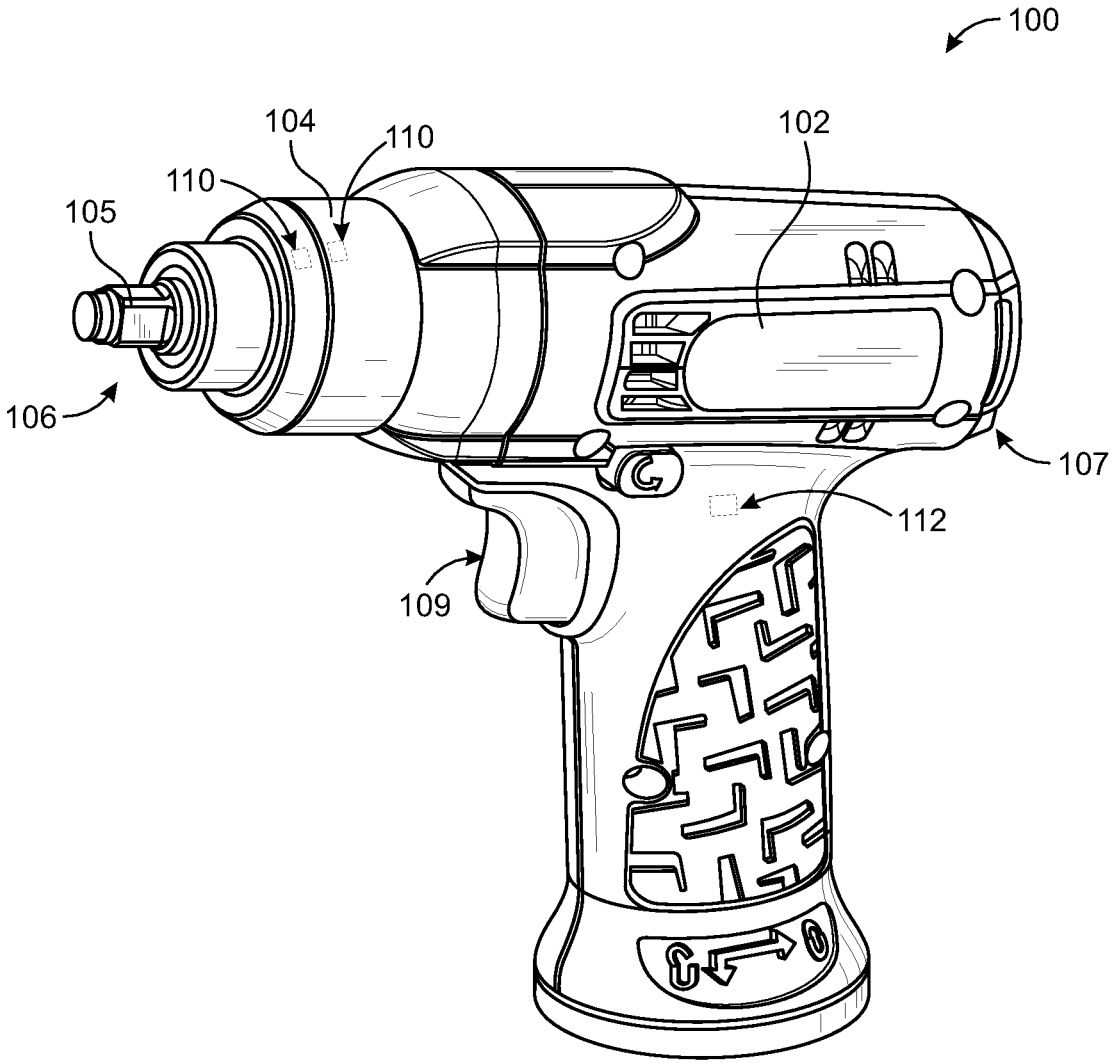
FIG. 1 illustrates a perspective view of at least one embodiment of an impact tool.

The various embodiments will be described in detail with reference to the accompanying drawings. Wherever possible, the same reference numbers will be used throughout the drawings to refer to the same or like parts. References made throughout this disclosure relating to specific examples and embodiments are provided solely for illustrative purposes but, unless indicated to the contrary, are not meant to limit all examples.

Embodiments disclosed herein generally relate to impact tools designed to minimize the negative effects of topping and/or to largely eliminate topping during normal tool operations. Generally, this disclosure describes various impact tools that are fitted with anti-topping mechanisms or designs ("anti-topping impact tools"). Anti-topping impact tools are adapted to reduce the rotational frictional force between the top surfaces of the at least one hammer jaw and the bottom surfaces of the at least one anvil jaw, in order to prevent topping or reduce the negative effects of possible topping. In the event topping still occasionally occurs, the disclosure addresses the need to quickly break loose the topped condition upon the next startup (e.g., next pull of the impact tool activation trigger).

As referenced herein, "topping" means external surfaces of an at least one hammer jaw of an impact tool stopping and resting in axially aligned contact with external surfaces of an at least one anvil jaw of the impact tool. When the at least one hammer jaw rests against the at least one anvil jaw, excessive force is required to overcome the friction between them in order to move them apart. Embodiments disclosed herein reduce this friction when the at least one anvil jaw and the at least one hammer jaw are in a topping (or "topped") position. These disclosed embodiments are used in impact tools, making these tools "anti-topping impact tools," as referenced herein.

To reduce the frictional torque between the jaws of the hammer and the anvil, some embodiments include an impact tool with an at least one anvil jaw having surfaces facing the hammer that are angled so that a corresponding at least one hammer jaw tends to naturally slide down the at least one anvil jaw when moving in a fastener driving direction. This is particularly useful as the negative effects of a topped condition are generally more troublesome when the tool is operated in the forward direction (i.e., in a fastener driving direction—typically clockwise). Particularly in electronically controlled torqueing tool operations the increased friction required to free the topped condition requires a relatively high motor amperage (compared to that amperage needed to rotate the hammer from a non-topped condition) and the amperage draw irregularity brought on by this topped condition can be problematic in processor control of the tool motor to ultimately output highly repeatable or accurate torque at the tool output.

Other embodiments include a cutout of a portion of the hammer jaw or anvil possible "topping" jaw surfaces so that only the innermost portion of the surfaces interact or otherwise are in contact when in a topped condition. The reduced radius of interaction zones lead to reduced the rotational frictional forces at least in part by minimizing the areas of the hammer jaw and the anvil jaw that contact each other during topping.

In still other embodiments, either one, both, or several of the anvil jaw and/or the hammer jaw surfaces are rounded (e.g., crowned) so as to reduce the amount of hammer or anvil surface in contact during a topped condition and also to provide, at least for some portion of the respective surfaces, a sloped surface that will facilitate relative movement of the hammer and anvil to an un-topped condition.

Other embodiments detect a topped condition at the end of any run of the tool using monitoring and control software.

Various sensors in the impact tool may detect the position of the anvil relative to the position of the hammer, identifying when the two are in a topping state. Upon detection of a topping state, the control software signals movement of the hammer as necessary to unlock the topped condition—either in the forward or reverse direction. Put another way, the disclosed monitoring and control software detects topping of the anvil and hammer and, consequently, nudges or moves the two apart, in certain instances, even prior to an operator's activating the tool motor (such as by pulling the tool trigger) for a next fastening operation of the tool.

In all embodiments in which a topped condition has not been cleared by the control software and related operations, the lower rotational frictional torque of the embodiment designs result in a lower rotational starting torque needed the next time the anti-topping impact tool is activated (e.g., on the next trigger pull of the anti-topping impact tool). In torque-controlled anti-topping impact tools, this lower rotational starting torque decreases the risk of accuracy or repeatability issues. Disclosed embodiments work to break the topping condition as quickly and easily as possible in a given situation as well as to reduce the likelihood of a topping circumstance occurring. Some embodiments are configured to reduce frictional torque between any interfacing parts (e.g., but not limited to, between the at least one hammer jaw and the at least one anvil jaw; or camshafts and cam thrust washers). Other embodiments are configured to try to hold the anvil stationary by increasing the rotational friction between the anvil and mating surfaces on the housing (e.g., hammer case) or nearby washer(s) or bushing (s) by moving the interfacing surfaces as outward as possible. Yet other embodiments use a combination of these strategies to reduce the frictional torque between interfacing surfaces of the hammer and anvil while increasing the rotational friction between the anvil and mating surfaces on the hammer case or nearby washer(s) or bushing(s).

FIG. 1 illustrates a perspective view of at least one embodiment of an impact tool 100. The impact tool 100 includes a motor 102, an impact mechanism 104 driven by the motor 102, and an output spindle 105 driven for rotation by the impact mechanism 104. The impact mechanism 104 includes an internal hammer and an anvil, both of which are shown in more detail in FIGS. 2-3. In operation, the impact tool 100 has a forward or output end 106 and a rear or input end 107. The impact tool 100 may be an impact wrench or other type of impact tool. Also shown in FIG. 1 is one or more sensors 110 and one electronic control system 112.

Figure 2:
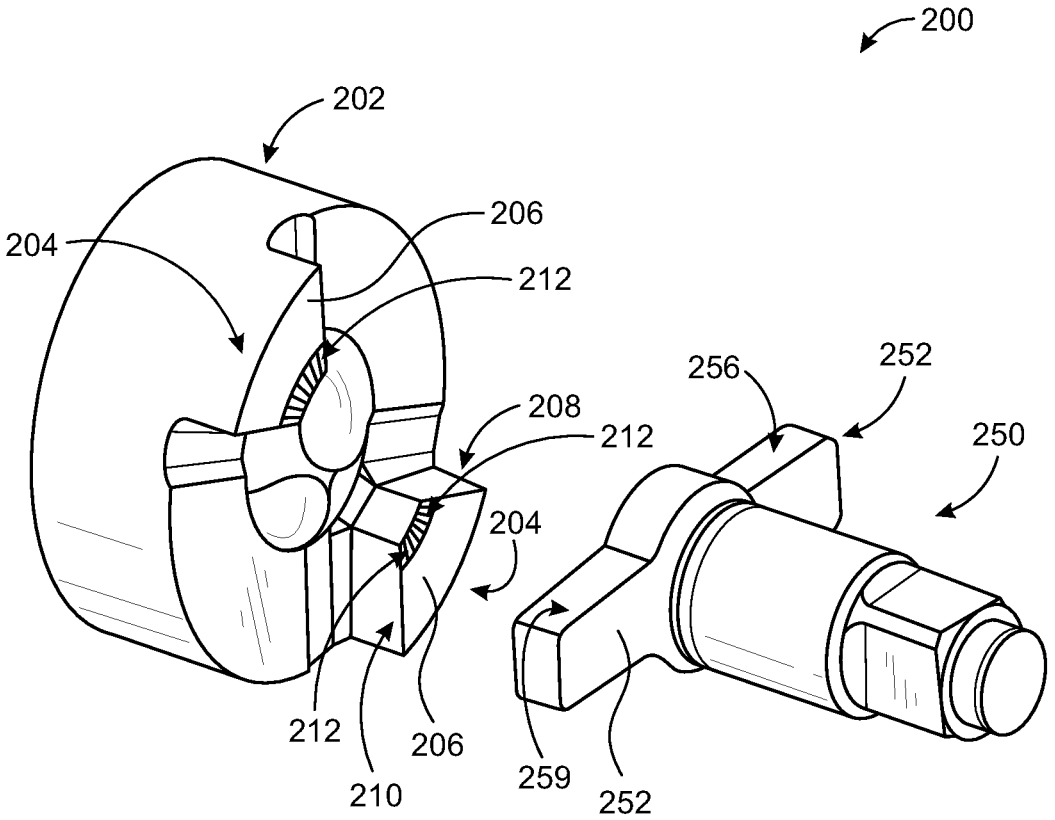
FIG. 2 illustrates a perspective view of at least one embodiment of an impact mechanism designed to reduce topping featuring an at least one hammer jaw having a raised surface.

FIG. 2 illustrates a perspective view of at least one embodiment of an impact mechanism 200 (e.g., the impact mechanism 104 of FIG. 1) designed to reduce topping featuring at least one hammer jaw with a raised surface. The impact mechanism 200 includes a hammer 202 and an anvil 250 that have various impact surfaces. The anvil 250 has at least one anvil jaw 252, and the hammer 202 has at least one hammer jaw 204.

Surfaces of the at least one hammer jaw 204 include but are not limited to: hammer jaw top surfaces 206; hammer jaw forward impact surfaces 208; and hammer jaw reverse impact surfaces 210. In one embodiment, the hammer jaw top surfaces 206 of each of the at least one hammer jaws 204 include hammer jaw raised surfaces 212 that serve to reduce the frictional forces of topping, as discussed in more detail below. In other embodiments, the hammer jaw top surfaces 206 are angled, sloped, crowned, or otherwise non-planar relative to anvil jaw top surfaces (facing the hammer 202, and not shown in FIG. 2).

Surfaces of the at least one anvil jaw 252 include but are not limited to: anvil jaw bottom surfaces (shown in FIG. 3 at 306); anvil jaw forward impact surfaces 259; and anvil jaw reverse impact surfaces 256. The anvil jaw bottom surfaces (306) of each of the at least one anvil jaw 252 may include raised, angled, sloped, crowned, or otherwise non-planar surfaces relative to the hammer jaw top surfaces 206.

In operation, the hammer 202, in these examples a part of a ball and cam impact mechanism, rotates into and out of contact with the anvil 250 through a spring or other biasing mechanism that pushes the hammer 202 toward the anvil, allowing the hammer jaw forward impact surfaces 208 of the hammer 202 to hit or impact the anvil jaw forward impact surfaces 259. Rotation of the output shaft 105 in a forward (for terms of this disclosure a clockwise or fastener tightening direction) may thus be driven by repeatedly turning the anvil 250 through impact of the hammer jaw forward impact surfaces 208 and the anvil jaw forward impact surfaces 259. Likewise, when operated in a reverse direction, the hammer reverse impact surfaces 210 impact the anvil reverse impact surfaces 256 to rotate a fastener in a counter-clockwise direction.

Topping occurs when the hammer jaw top surface 206 rests on top of the anvil jaw bottom surfaces (306). When topping occurs, a heightened torque is required from the motor 102 to overcome the friction between the hammer and anvil surfaces and spin the hammer 202 off of the anvil 250. This friction, which is between the hammer jaw top surfaces 206 and the anvil jaw bottom surfaces (306), is reduced in some embodiments by angling, sloping, crowning, or raising portions of the hammer jaw top surfaces 206, the anvil jaw bottom surfaces (306), or both.

In particular, some embodiments of the impact mechanism 200 reduce topping by reducing the frictional torque between the hammer jaws 204 and the anvil jaws 252 of the anvil 250. In the embodiment of FIG. 2, the hammer jaw raised surface 212 of the hammer jaw top surface 206 of the at least one hammer jaw 204 is the innermost portion of the hammer jaw top surface 206, and is the only portion of the hammer jaw top surface 206 that contacts the at least one anvil jaw 252 when the hammer 202 and the anvil 250 are at rest but in a topped condition (e.g., after a completed trigger pull). The reduced radius of interaction between the hammer jaw raised surface 212 and the anvil jaw 252 reduces the rotational frictional forces at least by minimizing the areas of the at least one hammer jaw 204 and the at least one anvil jaw 252 that contact each other during topping.

Figure 3:
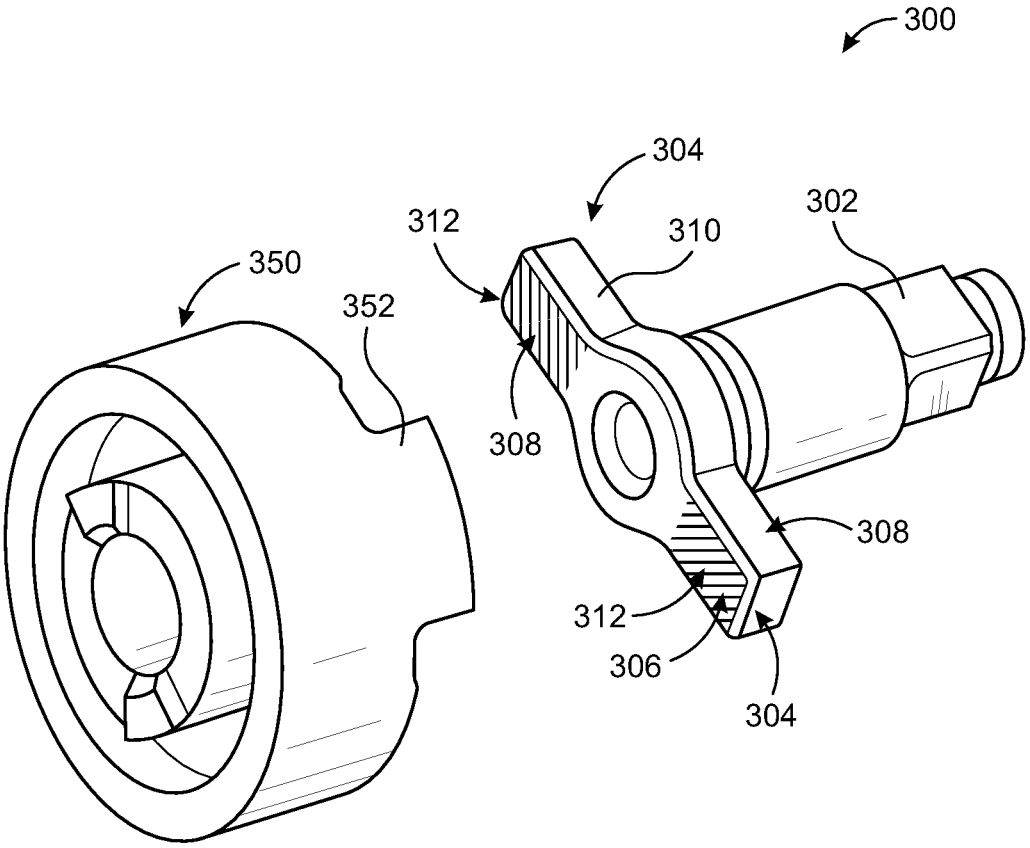
FIG. 3 illustrates a perspective view of at least one embodiment of an impact mechanism designed to reduce topping featuring an at least one anvil jaw having an angled surface.

FIG. 3 illustrates a perspective view of at least one embodiment of an impact mechanism 300 designed to reduce topping featuring an at least one anvil jaw having an angled surface. The impact mechanism 300 includes a hammer 350 and an anvil 302 that respectively comprise various impact surfaces. The hammer 350 further includes one or more hammer jaws 352. The anvil 302 comprises at least one anvil jaw 304. Surfaces of the at least one anvil jaw 304 include but are not limited to: anvil jaw bottom surfaces 306; anvil jaw forward impact surfaces 308; and anvil jaw reverse impact surfaces 310. In some embodiments, the anvil jaw bottom surface 306 of each of the anvil jaws 304 includes an anvil jaw angled surface 312 to reduce topping friction between the anvil 250 and the hammer 202. Alternative embodiments include angled, curved, crowned, and/or otherwise non-perpendicular to the axis of the anvil 302 anvil jaw bottom surfaces 306 relative to the hammer jaw top surface 206 (shown in FIG. 2).

In the depicted embodiment, each anvil jaw angled surface 312 of the anvil jaw bottom surface 306 of the at least one anvil jaw 304 is angled down from the forward impact anvil surface 308 to the trailing reverse impact anvil surface 310 of the hammer jaw 304. Each such anvil jaw angled surface 312 is angled so that the corresponding at least one hammer jaw 352 tends to naturally slide down the angled surface 312 of the at least one anvil jaw 304 when rotated in a forward direction, reducing the rotational frictional forces between the at least one anvil jaw 304 and the corresponding at least one hammer jaw 352 when the at least one anvil jaw 304 and the corresponding at least one hammer jaw 352 are in contact during topping.

Figure 4:
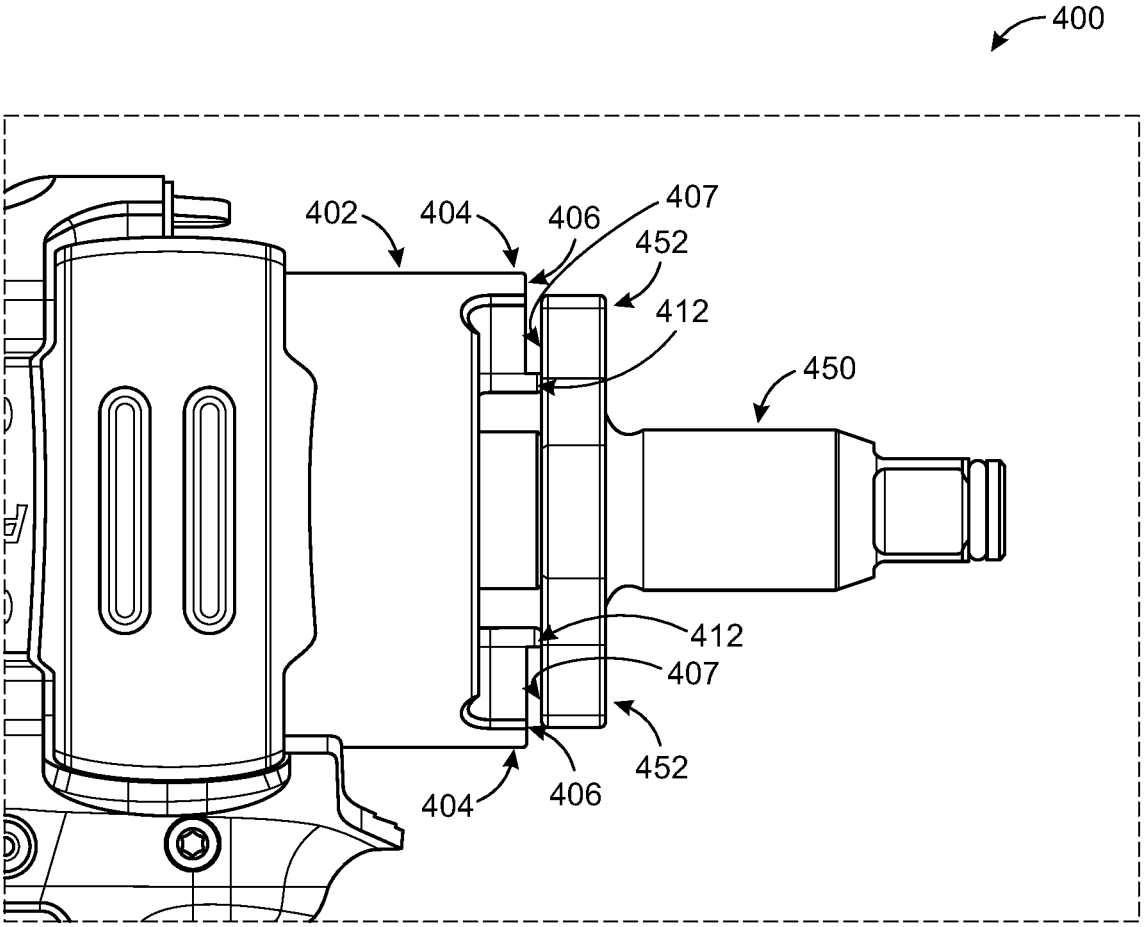
FIG. 4 illustrates a side elevational view of at least one embodiment of an impact mechanism designed to reduce topping featuring an at least one hammer jaw having a raised surface.

FIG. 4 illustrates a side elevational view of at least one embodiment of an impact mechanism 400 designed to reduce topping featuring hammer jaws 404 having raised surfaces 412 (or, in some embodiments, cut away surface 406) as also shown at 212 in FIG. 2. The raised surfaces 412 are located on the hammer jaw top surfaces 406, providing a much smaller surface area to possibly bear against the anvil jaw bottom surfaces 407 of the anvil jaws 404. In operation, the hammer jaw raised surfaces 412 of the hammer jaw top surfaces 406 are the only point of contact between the hammer jaws 404 and the anvil jaws 452 during a topping event. The reduced radius of interaction reduces the rotational frictional forces by at least minimizing the areas of the at least one hammer jaws 404 and the at least one anvil jaws 452 that contact each other during topping.

Figure 5:
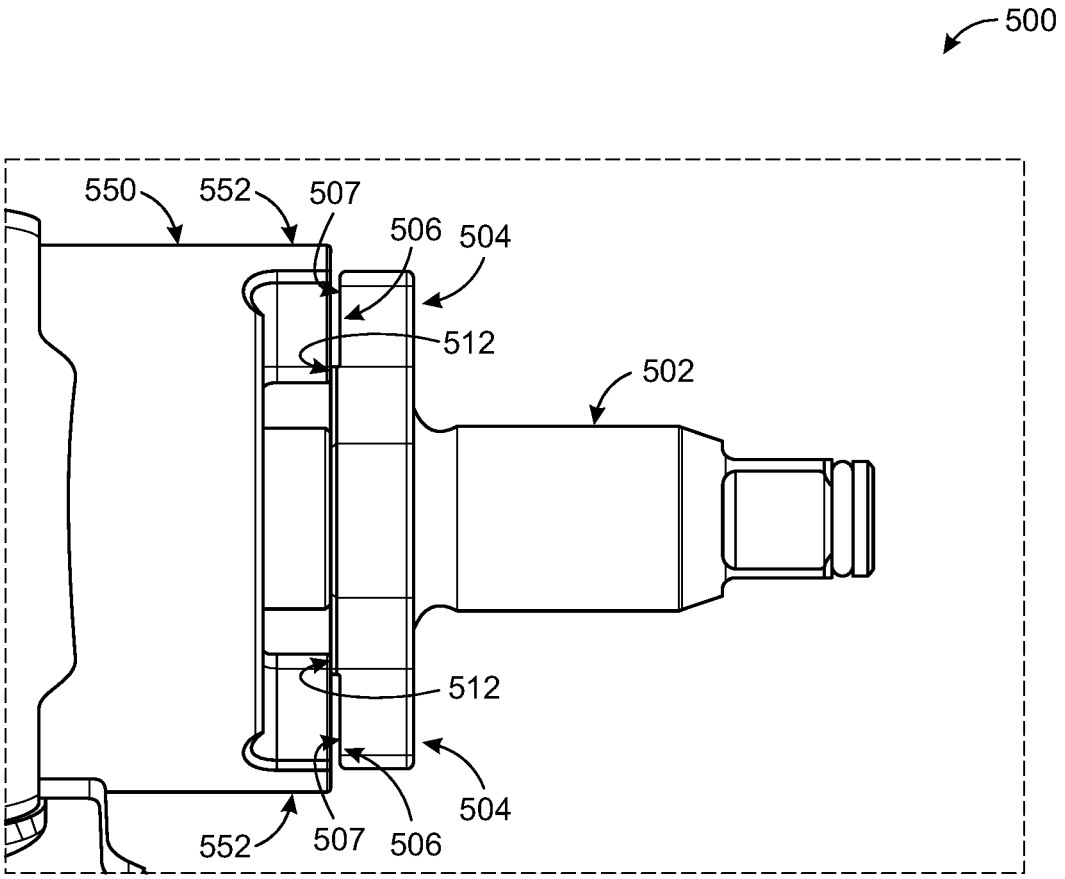
FIG. 5 illustrates a side elevational view of at least one embodiment of an impact mechanism designed to reduce topping featuring an at least one anvil jaw having a raised surface.

FIG. 5 illustrates a side elevational view of at least one embodiment of an impact mechanism 500 designed to reduce the effects of topping featuring anvil jaws having raised surfaces 512. The raised surfaces 512 are located on the anvil jaw bottom surfaces 507, providing a much smaller surface area to bear against the hammer jaw top surfaces 506 of the hammer jaws 552 in the event of a topping circumstance. In operation, the anvil raised surfaces 512 of the anvil jaw bottom surfaces 507 are the only points of contact between the hammer jaws 504 and the anvil jaws 552 during a topping event. The reduced radius of interaction reduces the rotational frictional forces by minimizing the areas of the at least one hammer jaw 552 and the at least one anvil jaws 504 that bear against each other during a topping circumstance.

Figure 6:
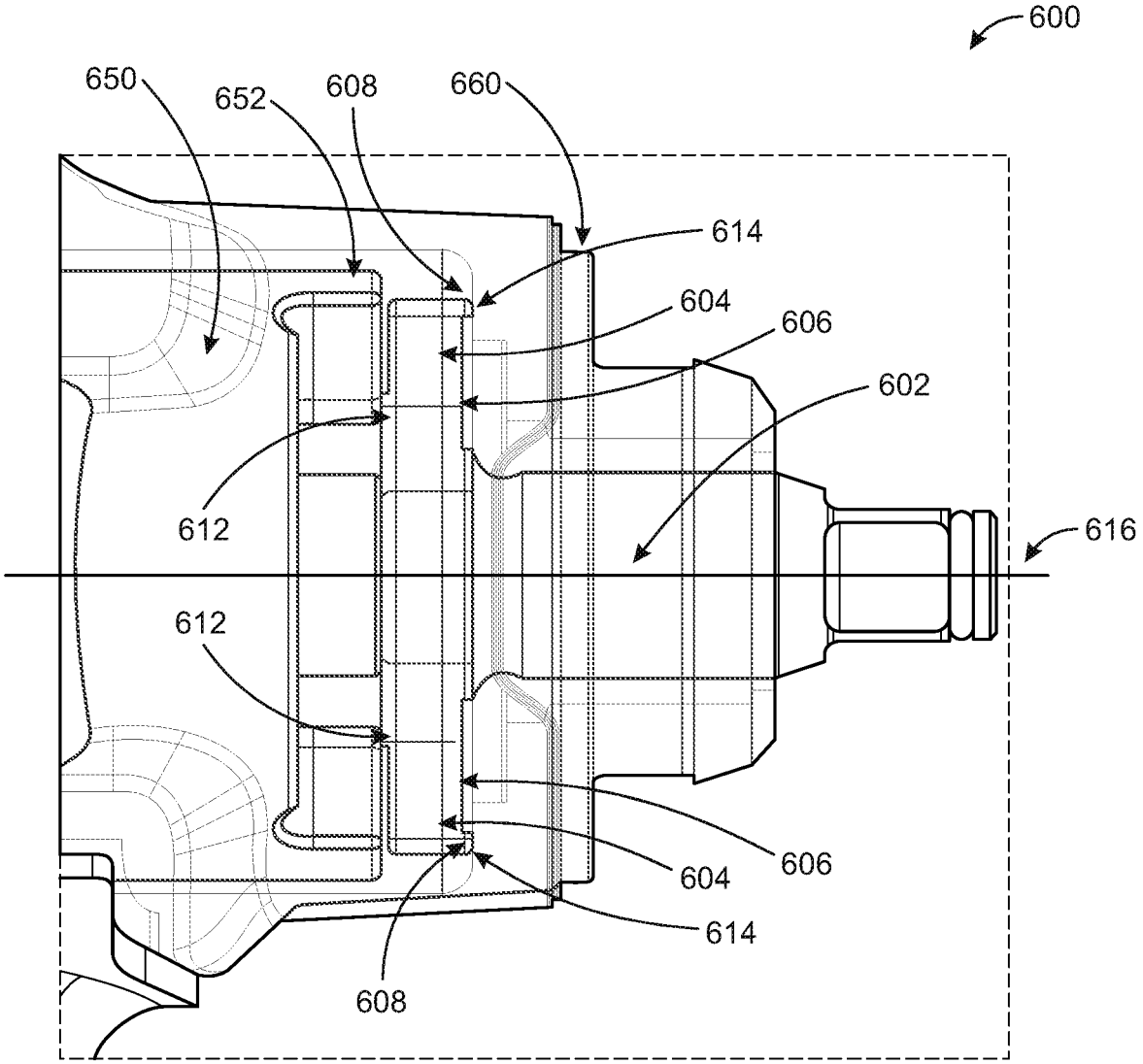
FIG. 6 illustrates a side elevational view of at least one embodiment of an impact mechanism designed to facilitate breaking free a hammer and anvil from a topped condition by providing friction between a peripheral surface of the anvil and an inner surface of a hammer case.

FIG. 6 illustrates a side elevational view of at least one embodiment of an impact mechanism 600 (e.g., the impact mechanism 104 of FIG. 1) designed to assist in clearing a topping condition and/or reduce the torque needed to break clear an impact assembly in a topping condition. In the embodiment of FIG. 6, and, speaking generally, the anvil jaw may have a raised peripheral surface that may bear against a hammer case or housing. The friction between the raised peripheral surface of the anvil jaw and the hammer case or housing serves to restrict the rotation of the anvil (as pressed against the hammer case or housing) when the motor is engaged to rotate the hammer to break free or clear a topping condition between the hammer and the anvil. In other words, the friction between the peripheral surface of the anvil jaw and the hammer case or housing tends to reduce the likelihood the anvil will turn with the hammer when the motor is engaged to break free the topping condition. In some implementations rather than increasing the rotational friction between the anvil and the hammer case, the rotational friction between the anvil and mating surfaces on a nearby washer or bushing may be increased such as by protruding surfaces that bear against the anvil, a washer, bushing and/or the housing.

Shown in FIG. 6 is a forward section of an impact tool 100, showing a housing or hammer case 660, an anvil 602, hammer 650, hammer jaws 652, and anvil jaws 604 having upper surfaces 606 orthogonal to an axis 616 of the anvil 602. On the radially peripheral edges of the anvil jaws 604 and disposed on the upper surfaces 606 are raised section 614 which in the event of a topped condition bear against an inner circumferential wall surface 608 of the hammer case 660. The friction between the inner circumferential wall surface 608 reduces the likelihood that the anvil 602 will spin with rotation of the hammer 650 when the motor 102 is activated to break free a topping condition between the hammer 650 and the anvil 602. In alternate embodiments, the radially peripheral edges of the anvil jaws 604 may not include raised surfaces (such as 614), but instead the inner circumferential wall surface 608 may further comprise a circumferential protruding surface or ring (not shown) that bears against the upper surfaces 606 of the anvil jaws 604 thus creating friction to similarly inhibit the free rotation of the anvil 602 when the motor 102 is activated to break free the hammer 650 from the anvil 602 in a topping condition and thus, in some instances, reducing the torque necessary from the motor 102 to break free the topping condition. In some embodiments it is advantageous to design the point(s) of friction between the anvil and the hammer case to be at the furthest reasonable radial extremity surface of the anvil jaws.

FIG. 6 also shows a raised surface 612 on the bottom surface 610 of the anvil jaws 604 (as also shown in FIG. 5). The combinations of raised surface 612 and raised surface 614 and/or a circumferential protruding surface or ring on the hammer case 660 may in some embodiments be used in the same device.

Figure 7:
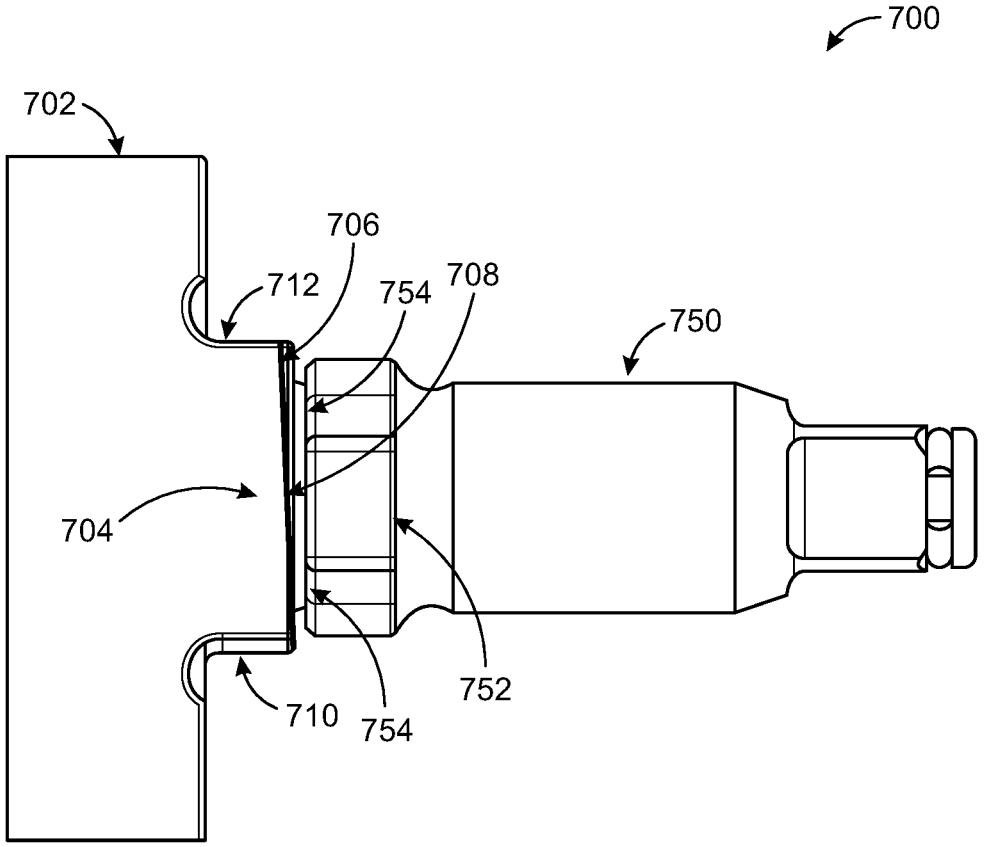
FIG. 7 illustrates a side elevational view of at least one embodiment of an impact mechanism designed to reduce topping featuring an at least one hammer jaw having an angled surface.

FIG. 7 illustrates a side elevational view of at least one embodiment of an impact mechanism 700 designed to reduce topping and/or facilitate breaking free a topping condition featuring an at least one hammer jaw having an angled surface. The impact mechanism 700 includes a hammer 702 and an anvil 750 that respectively comprise various impact surfaces. The anvil 750 further comprises an at least one anvil jaw 752 having an anvil jaw bottom surface 754. The hammer 702 comprises an at least one hammer jaw 704. Surfaces of the at least one hammer jaw 704 include but are not limited to a hammer jaw top surface 706. The hammer jaw top surface 706 of the at least one hammer jaw 704 further comprises a hammer jaw angled surface 708 angled relative to the anvil jaw bottom surface 754 of the at least one anvil jaw 752. The surface 708 may be sloped from a forward impact surface 710 of a hammer jaw 704 down to the reverse impact surface 712.

One such hammer jaw angled surface 708 is shown in FIG. 7. However, different embodiments of the impact mechanism 700 define the angle of the hammer jaw angled surface 708 relative to the anvil jaw bottom surface 754 differently, depending on the intended application. Some embodiments of the impact mechanism 700 reduce topping by reducing the frictional torque between the at least one hammer jaw 704 of the hammer 702 and the at least one anvil jaw 752 of the anvil 750. The hammer jaw angled surface 708 of the hammer jaw top surface 706 of the at least one hammer jaw 704 is angled so that the associated at least one hammer jaw 704 tends to naturally slide down the at least one anvil jaw 752. This is particularly suitable to breaking or reducing the occurrence of topping conditions manifested in the forward direction.

Figure 8:
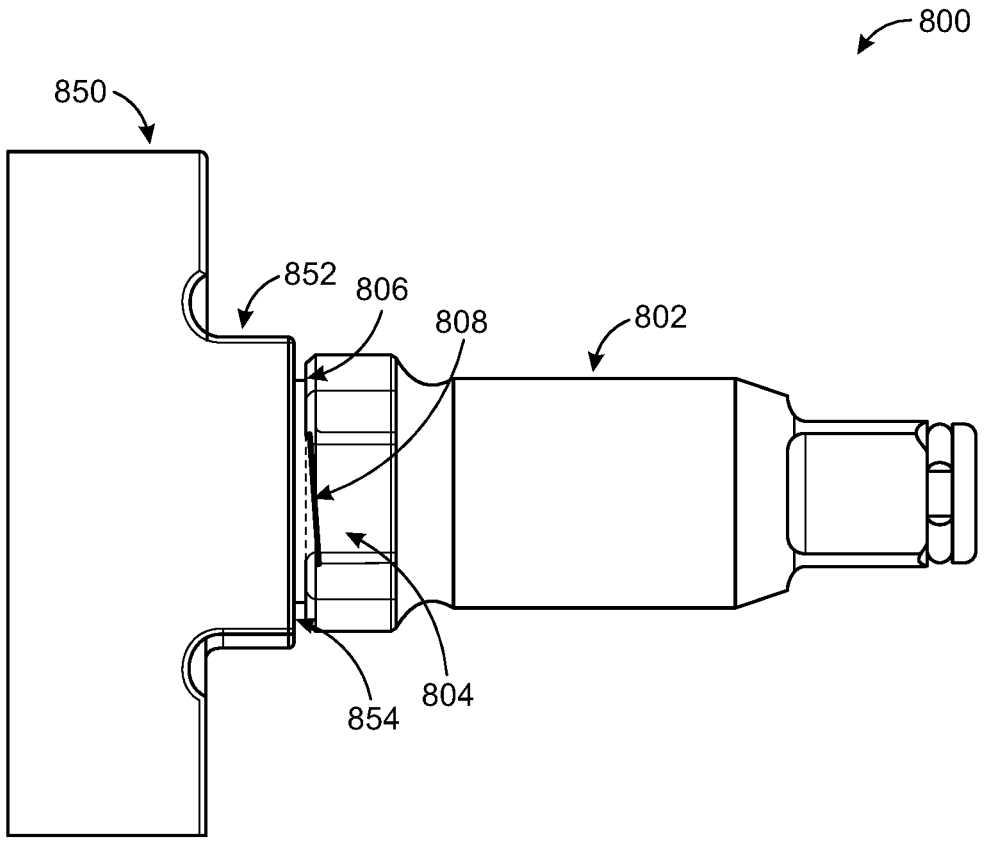
FIG. 8 illustrates a side elevational view of at least one embodiment of an impact mechanism designed to reduce topping featuring an at least one anvil jaw having an angled surface.

FIG. 8 illustrates a side elevational view of at least one embodiment of an impact mechanism 800 (e.g., the impact mechanism 104 of FIG. 1) designed to reduce topping and/or facilitate breaking free a topped condition featuring an at least one anvil jaw having an angled surface. The impact mechanism 800 includes a hammer 850 (e.g., the hammer 202 of FIG. 2) and an anvil 802 (e.g., the anvil 220 of FIG. 2) that respectively comprise various impact surfaces. The hammer 850 further comprises an at least one hammer jaw 852 having a hammer jaw top surface 854. The anvil 802 comprises at least one anvil jaw 804. Surfaces of the at least one anvil jaw 804 include but are not limited to an anvil jaw bottom surface 806. The anvil jaw bottom surface 806 of the at least one anvil jaw 804 further comprises an anvil jaw angled surface 808 angled relative to the hammer jaw bottom surface 854 of the at least one hammer jaw 852. The surface 806 may be sloped from a forward impact surface 810 of a anvil jaw 804 down to the reverse impact surface 812 of the anvil jaw 804.

One such anvil jaw angled surface 808 is shown in FIG. 8. However, different embodiments of the impact mechanism 800 define the angle of the hammer jaw angled surface 808 relative to the hammer jaw top surface 854 differently, depending on the intended application. Some embodiments of the impact mechanism 800 reduce topping by reducing the frictional torque between the at least one anvil jaw 804 of the anvil 802 and the at least one hammer jaw 852 of the hammer 850. The anvil jaw angled surface 808 of the anvil jaw bottom surface 806 of the at least one anvil jaw 804 is angled so that the associated at least one hammer jaw 852 tends to naturally slide down the at least one anvil jaw 804. This is particularly suitable to breaking topping conditions manifested in the forward direction.

The angled or sloped surfaces described in conjunction with FIGS. 7 and 8 serve to reduce the torque necessary to break free a topping condition when the motor is operated in a forward direction. However, the same angled or sloped surfaces would, in some instances, tend to increase the difficulty of breaking free a topped condition when the motor is operated in a reverse direction. The embodiments of FIGS. 4 and 5 reduce required frictional torque for breaking free a topping condition but do so in an equal bi-directional fashion such that the friction to break free from a topped condition in a forward and a reverse direction are the same.

Figure 9:
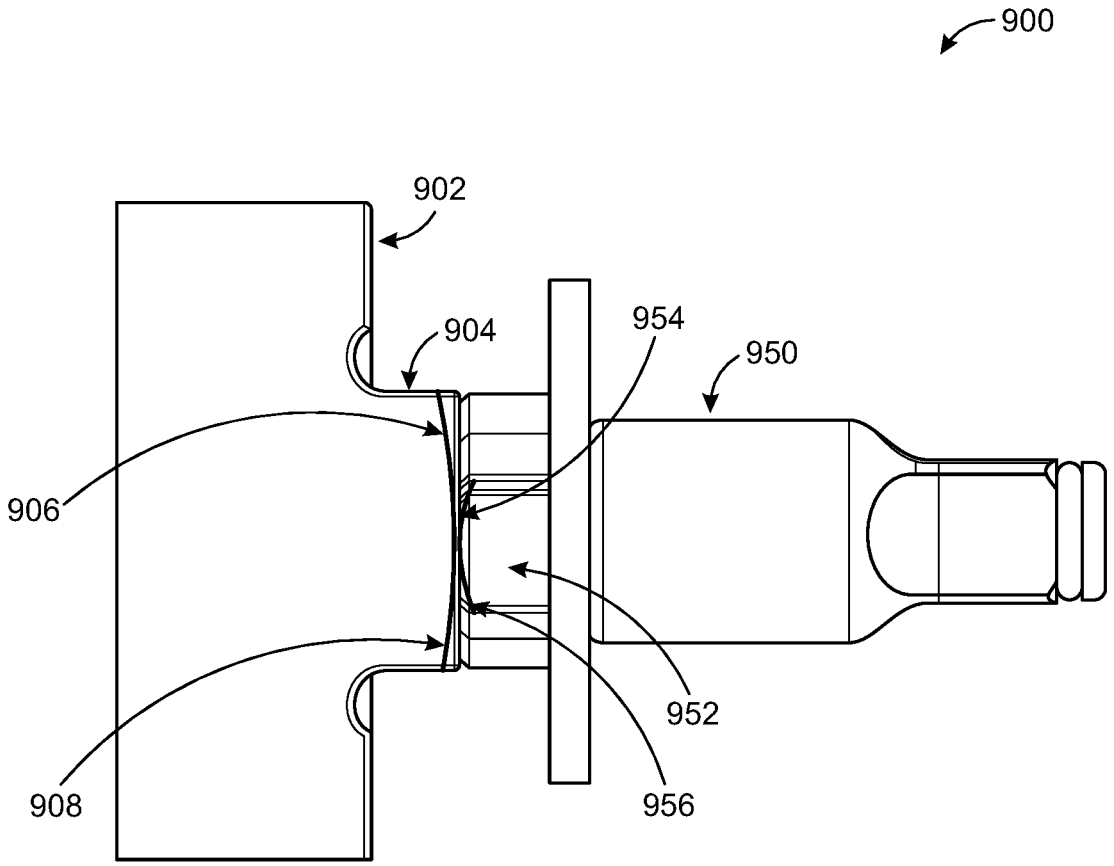
FIG. 9 illustrates a side elevational view of at least one embodiment of an impact mechanism designed to reduce topping featuring an at least one hammer jaw and an at least one anvil jaw each having a crowned surface.

FIG. 9 illustrates a side elevational view of at least one embodiment of an impact mechanism 900 (e.g., the impact mechanism 104 of FIG. 1) designed to reduce topping and/or reduce the occurrence of topping featuring an at least one hammer jaw and an at least one anvil jaw and either one of or each of such hammer jaw or anvil jaw having a crowned surface. The impact mechanism 900 includes a hammer 902 (e.g., the hammer 202 of FIG. 2) and an anvil 950 (e.g., the anvil 220 of FIG. 2) that respectively comprise various impact surfaces. The hammer 902 further comprises an at least one hammer jaw 904 having a hammer jaw top surface 906. The hammer jaw top surface 906 further comprises a hammer jaw crowned surface 908. The anvil 950 further comprises an at least one anvil jaw 952 having an anvil jaw bottom surface 954. The anvil jaw bottom surface 954 further comprises an anvil jaw crowned surface 956. The hammer jaw crowned surface 908 and the anvil jaw crowned surface 956 are both crowned (e.g., rounded). If only the hammer jaw has a crowned surface 908 (and the anvil jaw bottom surface 954 is flat) it is clear that the only contact between crowned surface 908 and anvil jaw bottom surface 954 is a single line that can transition angularly across the crowned surface 908 depending on the relative angular position of the flat anvil jaw bottom surface 954 vis a vis the crowned surface 908. Alternately, if only the anvil jaw has a crowned surface 954 and the hammer jaw 904 has a flat top surface 906 it is likewise that the only contact between crowned surface 954 and flat top surface 906 of the hammer jaw 904 is a single line that can transition angularly across the crowned surface 954 depending on the relative angular position of the flat top surface 906 of the hammer vis a vis the crowned surface 954. Once the relative positions of the one or more respective crowned surfaces have passed angularly in a rotation direction past the crown then the hammer upper surface 906 is biased toward sliding in a forward rotation direction vis a vis the bottom surface 954 of the anvil 950.

Except as otherwise stated explicitly herein, embodiments of the disclosure herein are compatible with all corded and cordless impact tools utilizing a ball and cam impact mechanism. This includes impact wrenches, for example. Depending on the intended application, some embodiments of the disclosed anti-topping impact tool comprise at least one, at least two, or more anvil jaw surfaces.

ADDITIONAL EXAMPLES

Some examples are directed to an impact tool. Such examples specifically include: a tool shaft adapted to rotate about an axis; a hammer adapted to rotate about the axis and comprising a hammer jaw, the hammer jaw comprising a hammer jaw forward impact surface and a hammer jaw top surface that may be perpendicular to the hammer jaw forward surface; and an anvil adapted to rotate upon impact with the hammer jaw, the anvil comprising an anvil jaw with an anvil jaw bottom surface and an anvil jaw forward impact surface that may be perpendicular to the anvil jaw bottom surface. In some such embodiments, the hammer jaw top surface is, at least partially, angled relative to the anvil jaw bottom surface.

Other examples are directed to an impact tool having: a tool shaft adapted to rotate about an axis; a hammer adapted to rotate about the axis, the hammer comprising a hammer jaw top surface, a hammer jaw forward impact surface, and a hammer jaw reverse impact surface; and an anvil adapted to rotate about the axis, the anvil comprising an anvil jaw bottom surface, an anvil jaw forward impact surface, and an anvil jaw reverse impact surface. In some such examples, the anvil jaw bottom surface includes a portion that is angled or crowned.

Still other examples are directed to an impact tool having: a tool shaft adapted to rotate about an axis; a hammer adapted to rotate about the axis and comprising at least one hammer jaw, the at least one hammer jaw having a hammer jaw top surface that is either crowned or angled; and an anvil adapted to rotate upon impact with the at least one hammer jaw, the anvil comprising an anvil jaw having an anvil jaw bottom surface facing the hammer. The anvil jaw bottom surface defines: a raised portion that protrudes from the anvil in the direction of the hammer, and a recess that extends out from the axis radially beyond the central anvil portion.

Some embodiments of the disclosed impact mechanisms (not shown) are comprised of combinations of:

at least one flat (non-angled) hammer jaw;
at least one flat (non-angled) anvil jaw;
at least one hammer jaw having a raised surface;
at least one anvil jaw having a raised surface;
at least one hammer jaw having an angled surface;
at least one anvil jaw having an angled surface;
at least one hammer jaw having a crowned surface;
at least one anvil jaw having a crowned surface; or
at least one anvil jaw having a raised peripheral surface.

Figure 10:
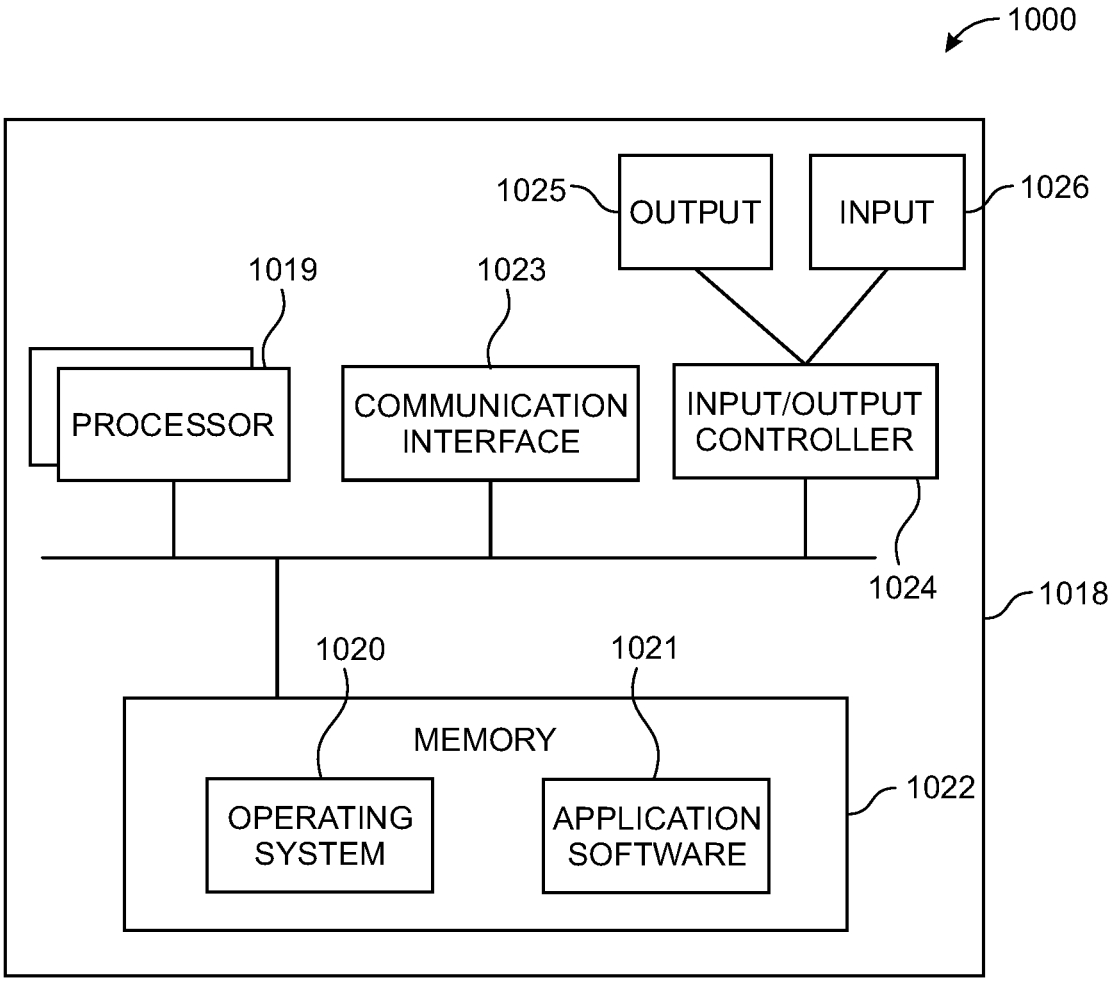
FIG. 10 is a block diagram illustrating an operating environment in accordance with at least one embodiment.

In some embodiments, the operating environment comprises computer readable media. FIG. 10 and the associated discussion herein implement such an operating environment.

The present disclosure is operable with a computing apparatus according to an implementation as a functional block diagram 1000 in FIG. 10. In some embodiments, the computing apparatus 1000 comprises or includes an electronic control system 112 shown in FIG. 1. In some embodiments, the electronic control system 112 is coupled to one or more sensors 110 signals from which facilitate the electronic control system's detection of a topped condition between the hammer and the anvil of the power tool. In some embodiments, the electronic control system 112 is operatively coupled to control the motor 104 and is operatively coupled to receive signals from the trigger 109 (such as a trigger pull signal). In some embodiments, the computing apparatus 1018 controls at least one sensor and a control unit. In such an implementation, components of a computing apparatus 1018 may be implemented as a part of an electronic device according to one or more implementations described in this specification. The computing apparatus 1018 comprises one or more processors 1019 which may be microprocessors, controllers or any other suitable type of processors for processing computer executable instructions to control the operation of the electronic device. Platform software comprising an operating system 1020 or any other suitable platform software may be provided on the apparatus 1018 to enable application software 1021 to be executed on the device.

Computer executable instructions may be provided using any computer-readable media that are accessible by the computing apparatus 1018. Computer storage media, such as a memory 1022, include volatile and non-volatile, removable and non-removable media implemented in any method or technology for storage of information such as computer readable instructions, data structures, program modules or the like.

The computing apparatus 1018 may comprise an input/output controller 1024 configured to output information to one or more output devices 1025. The input/output controller 1024 may also be configured to receive and process an input from one or more input devices 1026 such as, for example, sensors 110.

In some embodiments electronic control system may determine that a topped condition exists at the end of a trigger pull of the trigger 109. In some such embodiments, the electronic control system 112 may apply power to the motor 102 such that the hammer is advanced in either a forward direction or reverse direction so as to break free the sensed topped condition prior to a next trigger pull. In some embodiments, the electronic control system 112 may direct a predetermined torque be produced from the motor 104 to the hammer to break free a sensed topped condition. In some embodiments, the electronic control system 112 may comprise an active feedback loop with the one or more sensors 110 so that the motor 104 can be controlled in conjunction with signals from the one or more sensors 110 such that torque is applied sufficiently to break free a sensed topped condition and then torque is reduced.

It is to be understood that the above description is intended to be illustrative, and not restrictive. For example, the above-described embodiments (and/or aspects thereof) may be used in combination with each other. Furthermore, invention(s) have been described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention(s). Further, each independent feature or component of any given assembly may constitute an additional embodiment. In addition, many modifications may be made to adapt a particular situation or material to the teachings of the disclosure without departing from its scope. Dimensions, types of materials, orientations of the various components, and the number and positions of the various components described herein are intended to define parameters of certain embodiments and are by no means limiting and are merely exemplary embodiments. Many other embodiments and modifications within the spirit and scope of the claims will be apparent to those of skill in the art upon reviewing the above description. The scope of the disclosure should, therefore, be determined with reference to the appended claims, along with the full scope of equivalents to which such claims are entitled.

While the aspects of the disclosure have been described in terms of various examples with their associated operations, a person skilled in the art would appreciate that a combination of operations from any number of different examples is also within scope of the aspects of the disclosure.

When introducing elements of aspects of the disclosure or the examples thereof, the articles "a," "an," "the," and "said" are intended to mean that there are one or more of the elements. The terms "comprising," "including," and "having" are intended to be inclusive and mean that there may be additional elements other than the listed elements. The term "exemplary" is intended to mean "an example of" The phrase "one or more of the following: A, B, and C" means "at least one of A and/or at least one of B and/or at least one of C." As used herein, "ABC selectively attachable to XYZ" is defined to mean that ABC is removable from or reattachable to XYZ following the initial attachment of ABC to XYZ.

Having described aspects of the disclosure in detail, it will be apparent that modifications and variations are possible without departing from the scope of aspects of the disclosure as defined in the appended claims. As various changes could be made in the above constructions, products, and methods without departing from the scope of aspects of the disclosure, it is intended that all matter contained in the above description and shown in the accompanying drawings shall be interpreted as illustrative and not in a limiting sense.

What is claimed is:

1. An impact tool, comprising:

a tool shaft adapted to rotate about an axis;

a hammer adapted to rotate about the axis and comprising a hammer jaw, the hammer jaw comprising a hammer jaw forward impact surface and a hammer jaw top surface that is generally perpendicular to the hammer jaw forward surface;

an anvil adapted to rotate upon impact with the hammer jaw, the anvil comprising an anvil jaw with an anvil jaw bottom surface and an anvil jaw forward impact surface that is generally perpendicular to the anvil jaw bottom surface, wherein the hammer jaw top surface is, at least partially, angled relative to the anvil jaw bottom surface;

at least one sensor configured to detect a position of the hammer jaw relative to the anvil jaw; and a control unit configured to:

detect that the hammer jaw and the anvil jaw are in a topping state, and incident to said detection of the topping state, generate a signal for moving the hammer jaw to disrupt the topping state.

2. The impact tool of claim 1, wherein the hammer jaw top surface is crowned.

3. The impact tool of claim 1, wherein the hammer jaw top surface comprises a raised surface.

4. The impact tool of claim 1, wherein the generated signal is configured to cause a motor to rotate the hammer.

5. The impact tool of claim 1, wherein the generated signal is configured to cause a motor to rotate the hammer less than a full revolution of the hammer.

6. The impact tool of claim 1, wherein the anvil jaw bottom surface defines at least one raised surface that extends toward the hammer jaw top surface.

7. The impact tool of claim 1, wherein the anvil jaw bottom surface is angled relative to the hammer jaw top surface.

8. The impact tool of claim 1, wherein the anvil jaw bottom surface is crowned relative to the hammer jaw top surface.

9. The impact tool of claim 1, further comprising an electric motor configured to drive rotation of the hammer around the axis to cause impact of the hammer jaw with the anvil jaw.

10. The impact tool of claim 1, further comprising a pneumatic motor configured to drive rotation of the hammer around the axis to cause impact of the hammer jaw with the anvil jaw.

11. An impact tool, comprising:

a tool shaft adapted to rotate about an axis;

a hammer adapted to rotate about the axis and comprising, the hammer comprising a hammer jaw top surface, a hammer jaw forward impact surface, and a hammer jaw reverse impact surface;

an anvil adapted to rotate about the axis, the anvil comprising an anvil jaw bottom surface, an anvil jaw forward impact surface, and an anvil jaw reverse impact surface, wherein at least one of the hammer jaw top surface or the anvil jaw bottom surface includes a portion that is angled or crowned; and at least one sensor configured to detect a position of the hammer jaw relative to the anvil jaw; and a control unit configured to:

detect that the hammer jaw and the anvil jaw are in a topping state, and incident to said detection of the topping state, generate a signal for moving the hammer jaw to disrupt the topping state.

12. The impact tool of claim 11, wherein the hammer jaw top surface is either angled or crowned.

13. The impact tool of claim 11, wherein the hammer jaw top surface comprises a raised surface.

14. The impact tool of claim 11, further comprising an electric motor configured to drive rotation of the hammer around the axis to cause impact of the hammer jaw with the anvil jaw.

* * * * *